US005362262A

United States Patent [19]

Hotea

[11] Patent Number: 5,362,262

[45] Date of Patent: Nov. 8, 1994

[54] VIBRATION PROOF ELECTRICAL RECEPTACLE

[75] Inventor: Gheorghe Hotea, Griesheim, Germany

[73] Assignee: The Whitaker Corporation, Wilmington, Del.

[21] Appl. No.: 150,670

[22] Filed: Nov. 10, 1993

[30] Foreign Application Priority Data

Dec. 11, 1992 [GB] United Kingdom ..... 9225885.4

[51] Int. Cl.[5] ..... H01R 13/15

[52] U.S. Cl. ..... 439/839; 439/846

[58] Field of Search ..... 439/839, 846

[56] References Cited

U.S. PATENT DOCUMENTS 5,240,439 8/1993 Egenolf ..... 439/839
5,246,390 9/1993 Egenolf ..... 439/839

FOREIGN PATENT DOCUMENTS

0492479A2 7/1992 European Pat. Off. .
4109519A1 9/1992 Germany .

*Primary Examiner*—Daniel W. Howell
*Attorney, Agent, or Firm*—Eric J. Groen

[57] ABSTRACT

An electrical receptacle terminal is comprised of an outer spring member and an inner spring member. The inner spring member is axially movable within the outer spring member to compensate for vibration. A base wall of the upper spring portion is provided with a slot which defines spring strap portions which act as a secondary spring to the spring contact arms.

8 Claims, 3 Drawing Sheets

VIBRATION PROOF ELECTRICAL RECEPTACLE

BACKGROUND OF THE INVENTION

1. Field of the Invention

This invention relates to a receptacle for an electrical connector comprising a receiving portion for a pin-like or tab-like complementary contact of a complementary connector on a longitudinal end on a receiving side and a mounting portion on the other longitudinal end.

2. Summary of the Prior Art

Electrical connectors often are situated in an environment where they are exposed to mechanical load caused by shaking or oscillating movement or vibrations and/or stress due to thermal changes. Examples are electrical connectors used in machines or motor vehicles. If such connectors are situated in the engine compartment of a motor vehicle, not only does heavy mechanical load of the above-mentioned kind occur but also high differences in temperature occur especially during wintertime between the motor vehicle at standstill and being driven.

If the two connectors of a connector pair are attached to different parts or components moving relative to each other due to such mechanical and/or thermal stress, a corresponding relative motion between the connectors occurs, for example between contact pins or contact tabs of one connector and the receiving contacts, for example receiving sockets of the other connector of the connector pair. Such relative motion causes frictional corrosion leading to an impairment of the electrical contact between the pin contacts and the socket contacts.

An electrical receptacle is shown in EP Publication 0 492 479 which is movable longitudinally for use in high vibration atmospheres. This receptacle, as shown, is mainly for use on a printed circuit board where a mating pin can be inserted through the top of the receptacle, or through the bottom of the receptacle, through the board. For this reason, the contact arms are elongate, to centralize the pin contact point within the length of the receptacle. It is desirable to use a similar terminal for connection to a wire, for use in automotive applications.

SUMMARY OF THE INVENTION

It is the object of the invention to solve this problem, that is to avoid frictional corrosion even in those connector pairs whose connectors move relative to each other due to loads of the above mentioned kind.

The objects of the invention have been accomplished by providing a receptacle for receiving a complementary pin or tab, where the receptacle portion is resilient in longitudinal direction. The receptacle is characterized in that resilient spring contacts of the receptacle portion are attached to a further spring portion.

DETAILED DESCRIPTION OF THE PREFERRED EMBODIMENT

Figure 1:
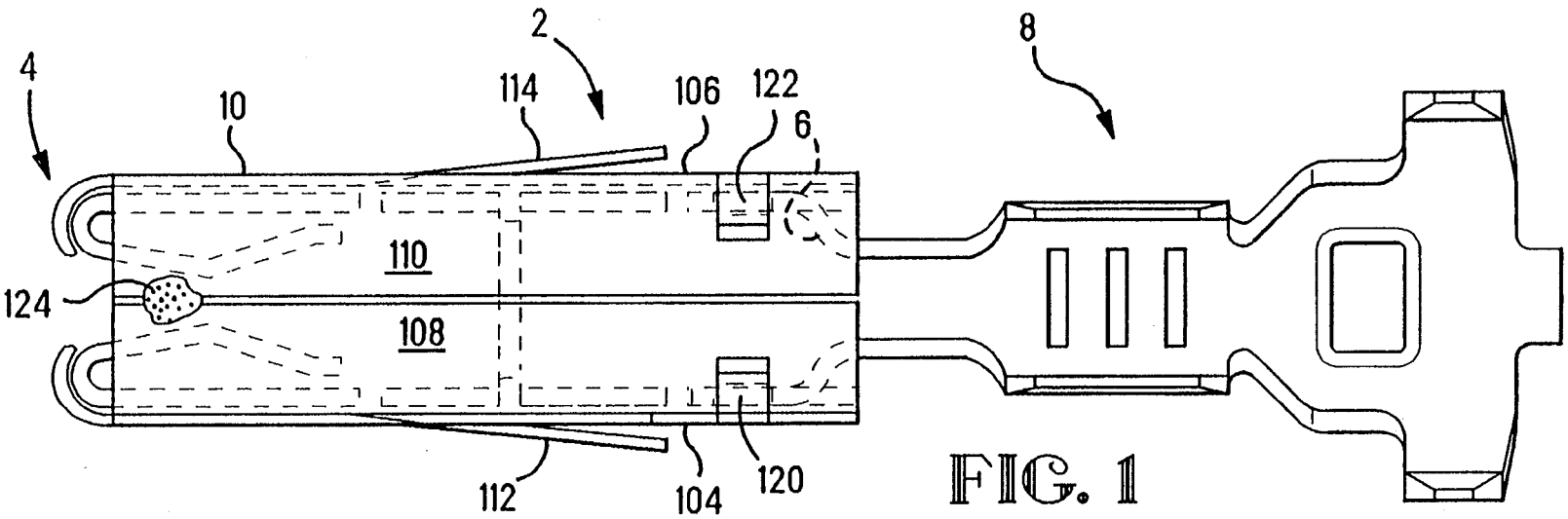
FIG. 1 is a top plan view of a receptacle contact in accordance with the invention.

With respect first to FIG. 1, an electrical receptacle is shown generally at 2 comprising a front mating section 4, a body or mounting portion 6, and a wire terminating section 8. An outer spring surrounds the receptacle front portion and is shown generally at 10.

Figure 4:
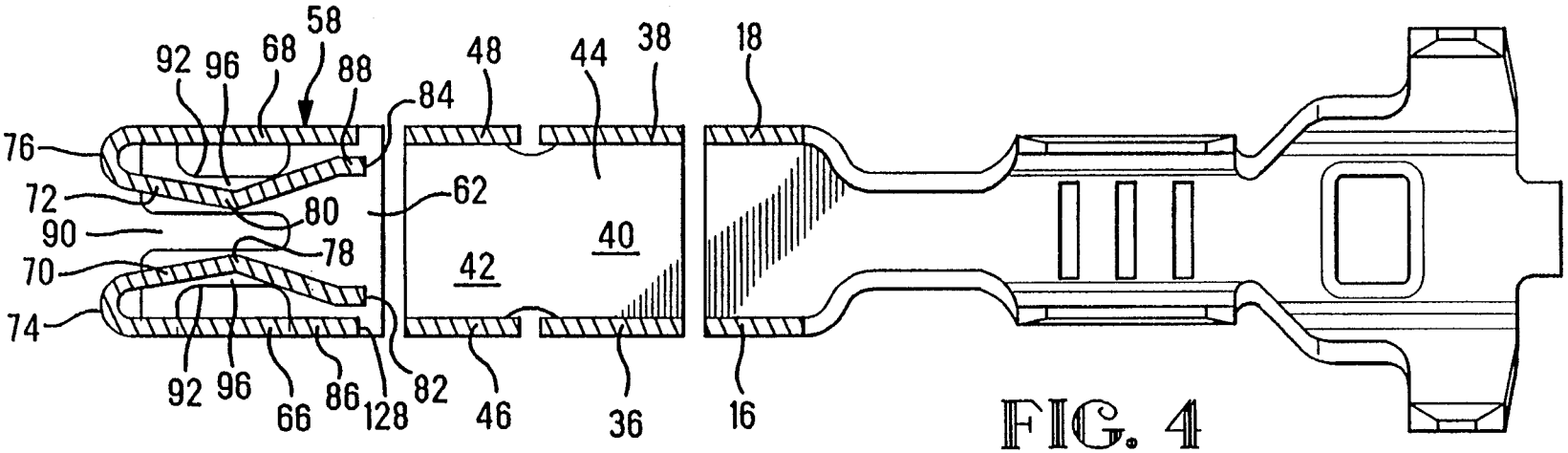
FIG. 4 is a cross sectional view similar to that of FIG. 3 without the outer spring.
Figure 5:
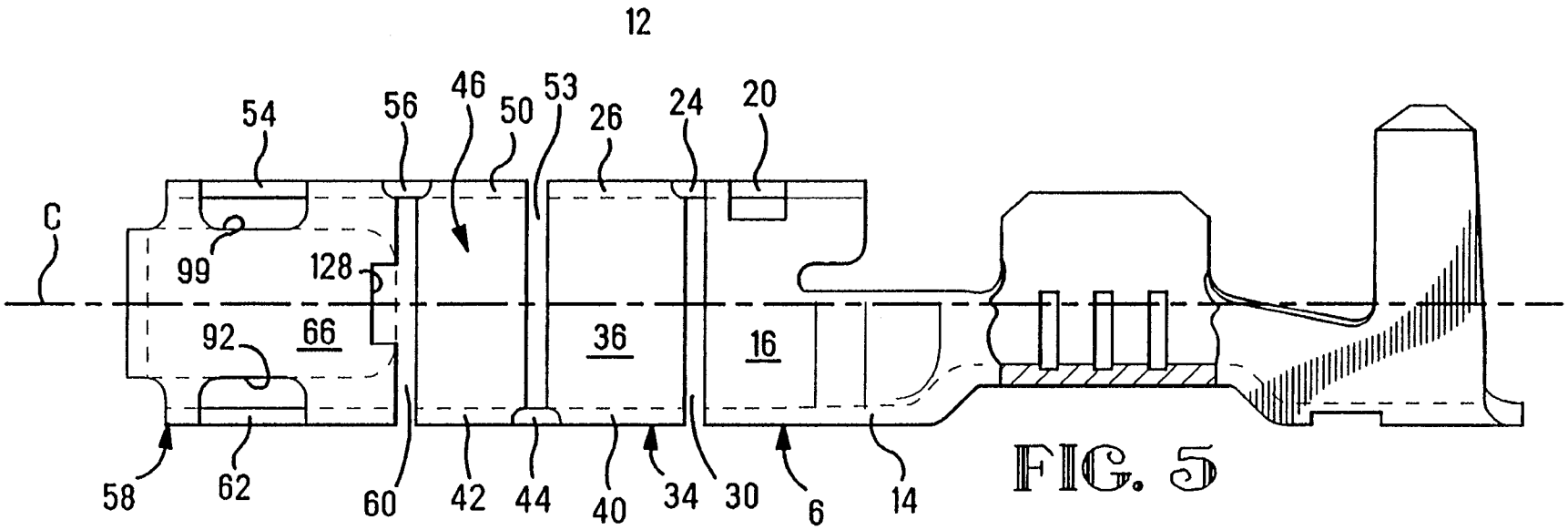
FIG. 5 a side plan view of the terminal, similar to that shown in, 2 without the outer spring.
Figure 6:
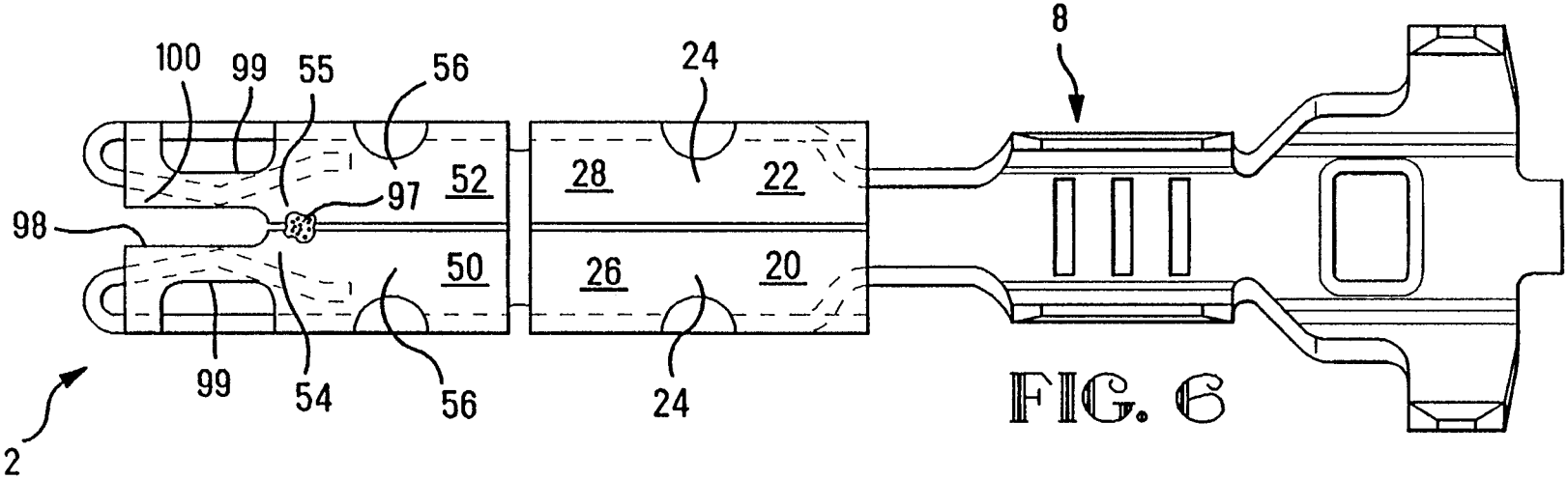
FIG. 6 is a side plan view of the inner terminal.

With respect now to FIGS. 4 and 5, the inner contact portion is shown as 12 and is generally box shaped in construction, where the base portion 6 includes a base wall 14, side walls 16 and 18 and top wall portions 20 and 22 (FIG. 6). As shown in FIGS. 5 and 6, the cover wall portions 20 and 22 extend upwardly at a web portion 24 to form wall portions 26 and 28, leaving a peripheral slit at 30 thereby forming a movable box portion 34 having side walls 36 and 38 and a base portion 40. The base portion 40 continues upwardly to form a base portion 42 interconnected by a medial web portion 44 to form a further box portion at 45 comprised of base portion 42, side walls 46 and 48 (FIG. 4) and top cover portions 50 and 52. The box portion 34 is separated from the box portion 45 via the peripheral slit at 53. Finally top cover portions 50 and 52 are continuous to form top cover portion 54 and 55 via a web 56 thereby forming an upper box portion 58.

The upper box portion 58 is separated from the box portion 45 at peripheral slit 60 thereby allowing the box portions 45 and 58 to be movable relative thereto about the web portion 56. The upper box portion 58 is comprised of a base portion 62 side walls 66 and 68 and the top wall portions 54 and 55. Contact arms 70 and 72 (FIG. 4) extend integrally from side wall portions 66 and 68 respectively about bight portions 74 and 76. The contact arms 70 and 72 have outward projections forming contact members 78 and 80 opposed from one another and are profiled to engage a mating tab member. The contact arms 70 and 72 are formed such that their ends 82 and 84 are positioned within the upper box portion 58. The contact arms 70 and 72 further include stop surfaces 86 and 88 which can abut the side walls 66 and 68 respectively to prevent over-stressing or plastically deforming the contact arms 70 and 72. The base wall 62 includes a slot 90 (FIG. 4) and openings 92 which, as shown in FIGS. 4 and 5 extend around into the side wall 66. The slot 90 together with the openings 92 define strap portions 96, which will be described in greater detail herein. As shown in FIG. 6, the top cover parts 54 and 55 are connected together by a spot weld at 97, and a second slot 98 is positioned above the weld 97. Two further openings are located at 99 which also extend into the side walls 66 and 68, as shown in FIG. 5, thereby forming strap portions 100, between the slot 98 and openings 99.

Figure 2:
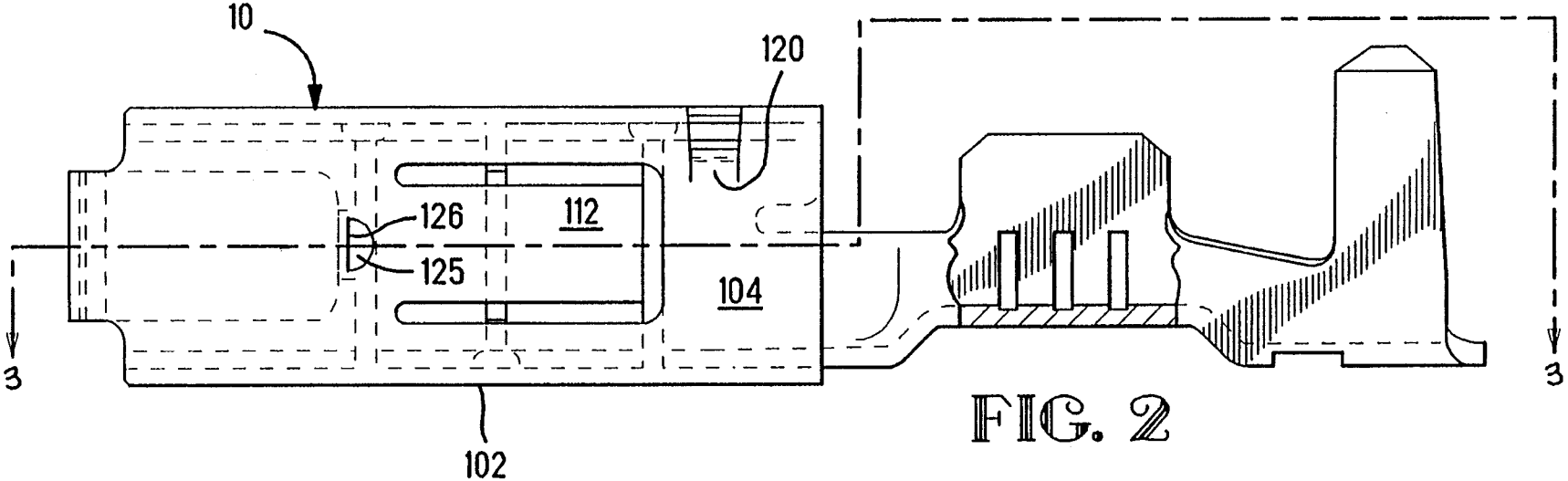
FIG. 2 is a side plan view of the terminal shown in FIG. 1.
Figure 3:
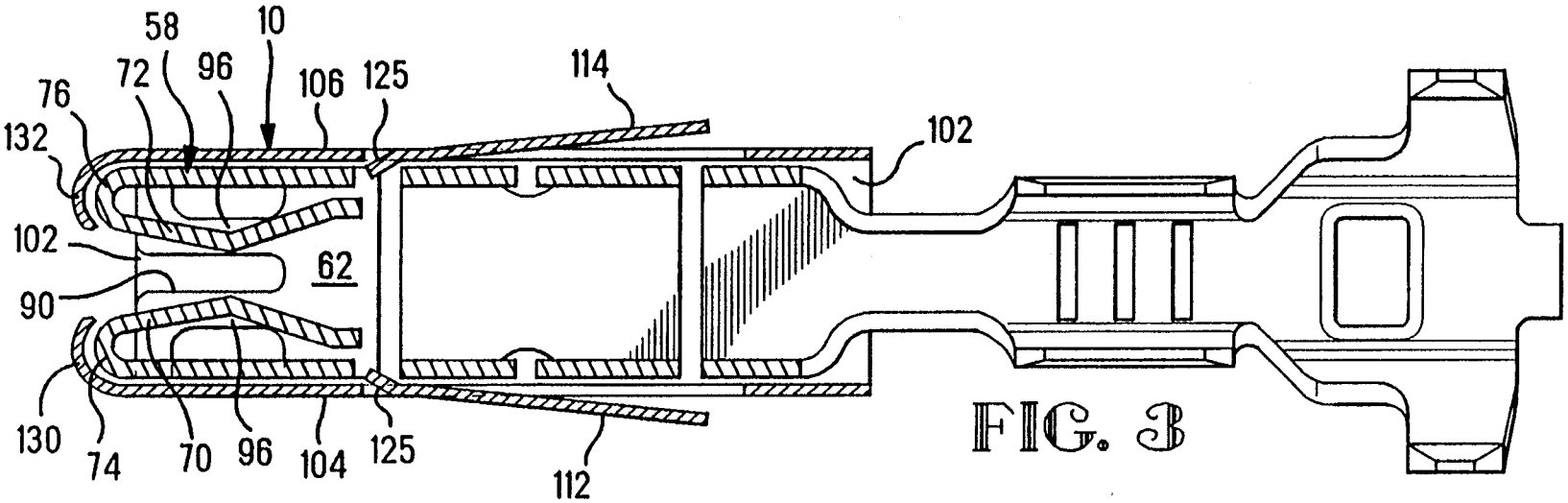
FIG. 3 is a cross sectional view through lines 3—3 of FIG. 2.

With respect now to FIGS. 1—3, the outer spring 10 will be described in greater detail. The outer spring 10 is generally box shaped in nature and overlies the receptacle portion of the inner spring member 12. The outer spring member 10 is comprised of a base portion 102 side walls 104, 106 and top cover parts 108, 110. Resilient locking lances 112 and 114 are stamped out of the side walls 104 and 106, respectively as shown in FIG. 2 and 3. The outer spring member 10 is fixed to the inner contact 12 by way of tab portions 120 and 122 which are sheared from the side walls 104 and 106 and partly from the cover members 108 and 110, being crimped over the top edges of side wall portions 16 and 18, as best shown in FIGS. 1 and 2. The cover parts 108 and 110 are fixed to each other at the front end, for example by spot welding at 124, however this spot weld 124 does not retain the inner spring contact 12 to the outer cover 10.

It should be appreciated that the box portions 34, 45 and 58 are movable axially along center line C as shown in FIG. 5 towards and away from the base portion 6, within the confines of the outer spring member 10. While the inner spring member 12 is allowed to move axially within the outer spring, stop means must be provided cooperatively between the inner spring member 12 and the outer spring member 10 to prevent over stressing the inner spring member 12. The outer spring member 10, and more particularly the side walls 104,106 include half moon shaped projections 125, as shown in FIGS. 2 and 3 which are formed by shearing lines at 126 (FIG. 2), and thereafter moving the sheet metal into the interior of the outer spring, as viewed in FIG. 3, thereby forming a stop surface at the shear line 126 to cooperate with an edge 128 (FIG. 5) on the top box portion 58 to control the extremity of the downward movement of the top box portion 58. With reference to FIG. 3, the outer spring 10 includes curved wing portions 130 and 132 overlying the bight portions 74 and 76, which controls the upper extreme movement of the box member 58.

Advantageously then, the electrical terminal shown in FIGS. 1—5 can be crimped to a wire via the wire interconnection section 8 and used in an atmosphere containing high vibration, such as for use in an automobile. Due to the axial movement of the terminal contact portion 12 the pin and receptacle can undergo vibration without fear of-fretting corrosion between the mating contact surfaces of the tab and contact portions 78 and 80. Also due to the short length of the contact arms 70 and 72, the contact arms are kept within the profile of the top box portion 58 thereby preventing any friction between the surfaces 86 and 88 of the contact arms 70 and 72 during the axial movement of the top box portion 58 during vibration. However due to the short length of the contact length portions 70 and 72, the base portion 62 is slotted at 90 thereby defining the strap portioned 96 which act as further spring members allowing spring action in the strap portions 96. Furthermore the terminal can be conventionally retained in the connector housing by way of the locking lances 112 and 114 as the primary lock, while the curved wing portions 130 and 132 (FIG. 3) of the outer spring 10 provide a flared entry way for a mating tab member.

I claim:

1. An electrical receptacle contact, comprising:

a body portion having a conductor connecting section extending from one end thereof;

an upper box section longitudinally movably connected to said body portion; and resilient contact arms reversely bent into said upper box section, having a length no longer than a length of said upper box section, thereby forming a receptacle section.

2. A receptacle according to claim 1, wherein said receptacle section is longitudinally guided by way of an outer spring body.

3. A receptacle according to claim 1, wherein the receptacle section is provided with a plurality of longitudinally spaced, transversely extending spring slots extending in alternating manner from opposing sidewalls, and extending to the respective opposing sidewall.

4. A receptacle according to claim 3, wherein said receptacle section is formed with a plurality of box shape members, adjacent box members being interconnected by way of webs of material, where said webs are alternating from side-to-side.

5. A receptacle according to claim 1, wherein a further spring portion is formed by a slot, on at least one wall of said top box portion, not containing a contact arm.

6. A receptacle according to claim 5, wherein opposing walls not containing said contact arms have a longitudinal slot forming strap portions flanking said slot.

7. A receptacle according to claim 1, wherein stop members are provided on said receptacle portion or said outer spring body, or cooperatively on both, to limit the longitudinal movement of said receptacle section in both directions.

8. A receptacle according to claim 7, wherein said outer spring body includes curved wing portions which overlie bight portions of said reversely bent spring contacts, and are spaced therefrom.

* * * * *